US008928574B2

(12) United States Patent
Takaya et al.

(10) Patent No.: US 8,928,574 B2
(45) Date of Patent: Jan. 6, 2015

(54) LIQUID CRYSTAL DISPLAY DEVICE

(75) Inventors: Mamoru Takaya, Osaka (JP); Eiichi Takakura, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 224 days.

(21) Appl. No.: 13/695,702

(22) PCT Filed: Jul. 4, 2011

(86) PCT No.: PCT/JP2011/065290

§ 371 (c)(1),
(2), (4) Date: Nov. 1, 2012

(87) PCT Pub. No.: WO2012/005218

PCT Pub. Date: Jan. 12, 2012

(65) Prior Publication Data

US 2013/0120235 A1 May 16, 2013

(30) Foreign Application Priority Data

Jul. 7, 2010 (JP) ..... 2010-154607

(51) Int. Cl.
*G09G 3/36* (2006.01)
*G09G 3/34* (2006.01)

(52) U.S. Cl.
CPC ..... *G09G 3/3406* (2013.01); *G09G 3/3648* (2013.01); *G09G 3/3426* (2013.01); *G09G 2310/024* (2013.01); *G09G 2310/08* (2013.01); *G09G 2320/0261* (2013.01); *G09G 2320/106* (2013.01); *G09G 2320/0646* (2013.01)
USPC ..... 345/102; 345/207; 345/211; 713/300; 713/320; 713/324

(58) Field of Classification Search
USPC ..... 345/102, 207, 211; 713/300, 320, 324
See application file for complete search history.

(56) References Cited

U.S. PATENT DOCUMENTS

| | | | | |
|---|---|---|---|---|
| 7,233,304 | B1 | 6/2007 | Aratani et al. | |
| 2003/0142118 | A1 | 7/2003 | Funamoto et al. | |
| 2009/0072748 | A1* | 3/2009 | Feng | 315/151 |
| 2009/0122087 | A1 | 5/2009 | Maruyama et al. | |
| 2009/0135127 | A1* | 5/2009 | Lee et al. | 345/102 |
| 2009/0167194 | A1* | 7/2009 | Mizuta | 315/151 |
| 2009/0225533 | A1* | 9/2009 | Yamagishi et al. | 362/97.2 |
| 2009/0295839 | A1* | 12/2009 | Furukawa et al. | 345/690 |

(Continued)

FOREIGN PATENT DOCUMENTS

| | | | |
|---|---|---|---|
| JP | 2000-275604 | A | 10/2000 |
| JP | 2000-321551 | A | 11/2000 |

(Continued)

*Primary Examiner* — Shaheda Abdin
(74) *Attorney, Agent, or Firm* — Birch, Stewart, Kolasch & Birch, LLP

(57) ABSTRACT

Provided is a liquid crystal display device wherein it is possible to specifically prevent the pseudo contouring of an area in which an image having a large motion vector is displayed, such as a telop area. A telop area (R1) (an example of a component image area) in which the motion vector is set in advance and which has a magnitude greater than or equal to a predetermined magnitude is detected. The intermittent lighting timing of an illumination portion is controlled in a manner such that the turn-off period having a predetermined length is set between the point in which the detected telop area (R1) writes a video signal to a liquid crystal element and the point in which the liquid crystal element responds.

4 Claims, 7 Drawing Sheets

(56) References Cited

U.S. PATENT DOCUMENTS

| | | | | |
|---|---|---|---|---|
| 2010/0053133 | A1* | 3/2010 | Furuta | 345/207 |
| 2010/0085478 | A1 | 4/2010 | Yamamoto et al. | |
| 2011/0025728 | A1 | 2/2011 | Baba et al. | |
| 2012/0169792 | A1* | 7/2012 | Yamashita et al. | 345/690 |

FOREIGN PATENT DOCUMENTS

| | | | |
|---|---|---|---|
| JP | 2002-287700 | A | 10/2002 |
| JP | 2004-309592 | A | 11/2004 |
| JP | 2005-128561 | A | 5/2005 |
| JP | 2006-323300 | A | 11/2006 |
| JP | 2009-134237 | A | 6/2009 |
| JP | 2009-198935 | A | 9/2009 |
| JP | 4355347 | B2 | 10/2009 |
| JP | 2010-97022 | A | 4/2010 |
| WO | 2010/073909 | A1 | 7/2010 |

* cited by examiner

ONE FRAME (1/120 SECOND)
ONE FRAME (1/120 SECOND)
ONE FRAME (1/120 SECOND)
ONE FRAME (1/120 SECOND)
TURN ON (1/480 SECOND)
TURN OFF (1/240 SECOND)
TURN ON (1/480 SECOND)
TURN OFF
TURN ON
TURN OFF
TURN ON
TURN OFF
TURN ON

LIQUID CRYSTAL DISPLAY DEVICE

TECHNICAL FIELD

The present invention relates to a liquid crystal display device including a liquid crystal panel and a backlight device and particularly to a technique of improving the moving image displaying performance with a so-called backlight scan process of sequentially intermittently lighting light sources in conjunction with writing of a video signal to the liquid crystal panel.

BACKGROUND ART

A liquid crystal display device including a liquid crystal panel displaying a video and a backlight device applying light to the liquid crystal panel from behind is recently widely spread for the use such as a television receiver and a displaying apparatus. In the liquid crystal display device, voltages applied to respective liquid crystal elements corresponding to pixels of the liquid crystal panel are controlled depending on a video signal and the display gradations (transmission factors) of the respective liquid crystal elements are adjusted to display video based on the video signal on the liquid panel.

To prevent motion blur and a pseudo contour generated when a moving image is displayed in the liquid crystal display device, the backlight device executes a backlight scan process of sequentially intermittently lighting light sources corresponding to respective partial areas when a display area of the liquid crystal panel is divided into a plurality of parts in conjunction with writing of a video signal to the liquid crystal elements in the partial areas in some cases (see, e.g., Patent Document 1).

FIG. 2 is a schematic of a general configuration of a backlight device 31 of a liquid crystal display device X according to an embodiment described later.

As depicted in FIG. 2, the backlight device 31 is provided with a LED light source group L30 having LED light sources L1 to L6 and a LED light source group L40 having LED light sources L7 to L12 corresponding to partial areas R50 and R60 when a display area of a liquid crystal panel 21 is vertically divided into two parts. Each of the LED light sources L1 to L12 includes a plurality of LEDs (light-emitting diodes) 31*a* horizontally arranged side-by-side. The backlight device 31 controls the turning on and off of the LED light sources L1 to L12 on the basis of the LED light source groups L30 and L40.

Specifically, the backlight device 31 executes the backlight scan process of sequentially intermittently lighting the LED light source groups L30 an L40 in conjunction with writing of a video signal to the partial areas R50 and R60 of the liquid crystal panel 21. A general backlight scan process will hereinafter be described with reference to FIGS. 7 to 9.

As depicted in FIG. 7, the LED light source group L30 is intermittently lit in timing that causes the LED light source group L30 to be turned on for 1/480 second, turned off for 1/240 second, and turned on for 1/480 second from the start of writing of a video signal (shaded portion) to the partial area R50 of the liquid crystal panel 21. Similarly, the LED light source group L40 is intermittently lit in timing that causes the LED light source group L40 to be turned on for 1/480 second, turned off for 1/240 second, and turned on for 1/480 second from the start of writing of a video signal to the partial area R60 of the liquid crystal panel 21.

However, as depicted in FIG. 7, an upper end area R11 and a center area R12 of the partial area R50 have different relationships between the write timing of the video signal to the liquid crystal elements and the timing of intermittent lighting of the LED light source group L30, leading to different prevention effects on a pseudo contour when a moving image is displayed. This point will hereinafter be described.

FIG. 8 depicts a relationship between the write timing of a video signal to the liquid crystal elements and the timing of intermittent lighting of the LED light source group L30 in the area R11, and FIG. 9 depicts a relationship between the write timing of a video signal to the liquid crystal elements and the timing of intermittent lighting of the LED light source group L30 in the area R12. As depicted in FIGS. 8 and 9, if an applied voltage to a liquid crystal element is varied to change the display gradation of the liquid crystal element from 100 to 128, the gradation (transmission factor) is subsequently gradually changed in the liquid crystal element. The response time of the liquid crystal element is assumed to be 1/120 second corresponding to one frame.

As depicted in FIG. 8, in the area R11, the LED light source group L30 is intermittently lit in timing that causes the LED light source group L30 to be turned on for 1/480 second (time T11 to T12), turned off for 1/240 second (time T12 to T13), and turned on for 1/480 second (time T13 to T14) from the start of writing of a video signal to the liquid crystal elements. The area R11 is provided with a turn-off period in the middle of a period from the start of a response of the liquid crystal elements until the end of the response of the liquid crystal elements and is continuously turned on for a short time of 1/480 second during the response. Therefore, the pseudo contour can effectively be prevented when a moving image is displayed in the area R11, thereby improving the moving image displaying performance.

On the other hand, as depicted in FIG. 9, in the area R12, the LED light source group L30 is intermittently lit in timing that causes the LED light source group L30 to be turned off for 1/240 seconds (time T21 to T22) and turned on for 1/240 second (time T22 to T23) from the start of writing of a video signal to the liquid crystal elements. The area R12 is continuously turned on for a longer time (1/240 second) during the response of the liquid crystal elements as compared to the area R11. Therefore, the prevention effect on the pseudo contour is reduced when a moving image is displayed in the area R12 as compared to the area R11.

PRIOR ART DOCUMENTS

Patent Documents

Patent Document 1: Japanese Laid-Open Patent Publication No. 2005-128561

Patent Document 2: Japanese Patent Publication No. 4355347

SUMMARY OF THE INVENTION

Problem to be Solved by the Invention

It is known that video displayed on the liquid crystal panel 21 has a more noticeable pseudo contour in an area having a larger motion vector. Particularly, a telop area has a display position moving horizontally in the liquid crystal panel 21 and generally has a greater contrast so as to enhance readability for users and, therefore, a pseudo contour generated in the telop area is easily noticed. Methods of detecting a motion vector and a telop area are disclosed in Patent Document 2, for example.

If the liquid crystal display device X has an area displaying an image with a large motion vector located in the area R11 having a higher prevention effect on a pseudo contour, a higher prevention effect can be produced on the pseudo contour of the image with a large motion vector.

However, since the area displaying an image with a large motion vector is not constant, if the area is located in the area R12 having a lower prevention effect on a pseudo contour as described above, it is problematic that the higher prevention effect cannot be produced on the pseudo contour of the image with a large motion vector. Such a problem becomes prominent with a smaller division number as in the case of dividing the LED light sources L1 to L12 into the two LED light source groups L30 and L40 as described above.

Therefore, the present invention was conceived in view of the situations and it is an object of the present invention to provide a liquid crystal display device capable of intensively preventing a pseudo contour in an area displaying an image with a large motion vector as in the telop area.

Means for Solving the Problem

To achieve the object, the present invention is applied to a liquid crystal display device that has a backlight device including two illuminating portions for individually illuminating each of partial areas which is obtained by dividing a display area of a liquid crystal panel with a plurality of liquid crystal elements into two parts from behind, a backlight control portion sequentially intermittently lighting each of the illuminating portions in conjunction with writing of a video signal to the liquid crystal elements corresponding to the respective partial areas in the liquid crystal panel, and a motion vector detecting portion detecting a motion vector based on the video signal, comprising: an elemental image area detecting portion for detecting an elemental image area where the motion vector detected by the motion vector detecting portion equals to or greater than predetermined magnitude set in advance from the partial areas for each of the partial areas; and an intermittent lighting timing control portion for controlling timing of intermittent lighting of the illuminating portion by the backlight control portion such that, if the elemental image area detecting portion detects the elemental image area only in one of the partial areas, a turn-off period is provided for a predetermined time in the middle of a period between the start of writing of a video signal to the liquid crystal elements corresponding to the elemental image area detected by the elemental image area detecting portion and the elapse of a response time of the liquid crystal elements based on timing of the start of writing of a video signal to the liquid crystal elements corresponding to the elemental image area and the two illuminating portions are alternatively turned on, and also if the elemental image area detecting portion detects the elemental image area in each of the partial areas, a turn-off period is provided for a predetermined time in the middle of a period between the start of writing of a video signal to the liquid crystal elements corresponding to the elemental image and the elapse of a response time of the liquid crystal elements in each of the partial areas based on timing of the start of writing of a video signal to the liquid crystal elements corresponding to each of the elemental image areas. Each of the illuminating portions is made up of a light-emitting diode, a cold-cathode tube, etc.

According to the present invention, the timing of intermittent lighting of the illuminating portion is adjusted on the basis of the elemental image area such as a telop area having a large motion vector making a pseudo contour easily noticeable and, therefore, the pseudo contour can intensively be prevented in the elemental image area and the moving image displaying performance of the liquid crystal display device can be improved.

And, the pseudo contour of the elemental image area can effectively be prevented in each of the partial areas by appropriately controlling the timing of intermittent lighting of the illuminating portion for the elemental image area in each of the partial areas.

For example, since a telop area having a display position moving in a predetermined direction of the liquid crystal panel tends to attract attention of a viewer, it is particularly important for the liquid crystal display device to improve the moving image displaying performance in the telop area. Therefore, it is desirable that the elemental image area detecting portion detects an area where the motion vector equals to or greater than a predetermined magnitude set in advance and a display position moves in a predetermined direction of the liquid crystal panel as a telop area and handles the telop area as the elemental image area.

It is conceivable that the elemental image area detecting portion detects an elemental image area where the motion vector is largest from elemental image areas where the motion vectors equal to or greater than a predetermined magnitude set in advance.

A pseudo contour becomes more visible when contrast of video is larger. Therefore, it is conceivable that the elemental image area detecting portion detects an elemental image area where contrast is the largest from elemental image areas where the motion vectors equal to or greater than a predetermined magnitude set in advance.

It is desirable that the elemental image area detecting means detects the elemental image area for each of the partial areas, and the intermittent lighting timing control means individually controls the timings of intermittent lighting of the respective illuminating means by the backlight control means such that a preset relationship is achieved in each of the partial areas between the write timing of a video signal to the liquid crystal elements in the elemental image area and the timing of intermittent lighting of the illuminating means. As a result, the pseudo contour of the elemental image area can effectively be prevented in each of the partial areas by appropriately controlling the timing of intermittent lighting of the illuminating means for the elemental image area in each of the partial areas.

The predetermined relationship may be set in advance as a condition when the pseudo contour is most effectively prevented depending on the response characteristics of liquid crystal elements in the liquid crystal panel of the liquid crystal display device. For example, if the pseudo contour is most effectively prevented when a turn-off period is provided for a predetermined time in the middle of a period from the start of writing of a video signal to the liquid crystal elements until a response time of the liquid crystal elements has elapsed, the intermittent lighting timing control means may control the timing of intermittent lighting of the illuminating means by the backlight control means such that a turn-off period is provided for a predetermined time in the middle of a period between the start of writing of a video signal to the liquid crystal elements in the elemental image area and the elapse of a response time of the liquid crystal elements.

Effect of the Invention

According to the present invention, since the intermittent lighting timing of the illuminating portion is adjusted on the basis of the elemental image area such as a telop area having a larger motion vector causing a noticeable pseudo contour, a pseudo contour can intensively be prevented in the elemental image area, thereby improving the moving image displaying performance of the liquid crystal display device.

MODE FOR CARRYING OUT THE INVENTION

An embodiment of the present invention will now be described with reference to the accompanying drawings to facilitate the understanding of the present invention. The following embodiment is an example embodying the present invention and does not limit the technical scope of the present invention in nature.

Figure 1:
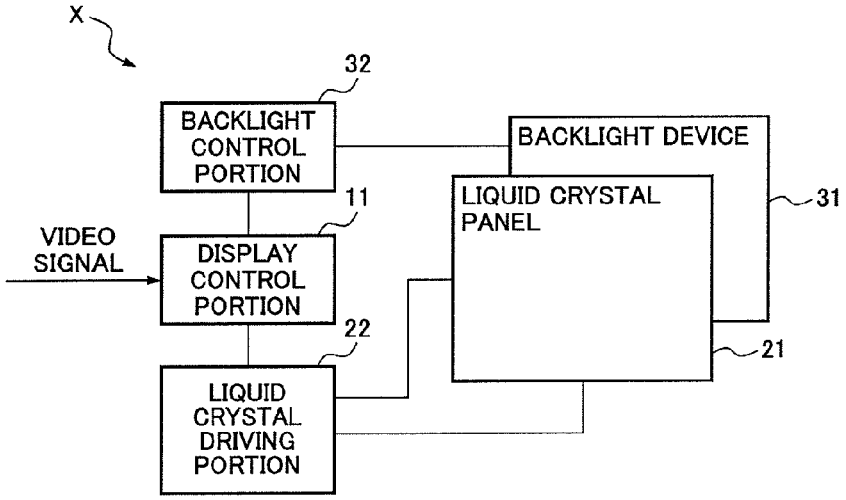
FIG. 1 is a block diagram of a main portion in a general configuration of a liquid crystal display device according to an embodiment of the present invention.

As depicted in FIG. 1, a liquid crystal display device X according to an embodiment of the present invention includes a display control portion 11, a liquid crystal panel 21, a liquid crystal driving portion 22, a backlight device 31, a backlight control portion 32, etc. The liquid crystal display device X is, for example, a display apparatus used for a television receiver or a personal computer. In this embodiment, the other constituent elements included in a typical television receiver or display apparatus and having no direct effect on the present invention will not be described.

The liquid crystal panel 21 is a conventionally well-known active-matrix type liquid crystal panel made up of a liquid crystal layer and scanning electrodes and data electrodes for applying a scanning signal and a data signal to the liquid crystal layer, and having a plurality of liquid crystal elements with transmission factors changed by an applied voltage.

The display control portion 11 receives a video signal included in television broadcast received by an antenna (not depicted) or in video contents input from an external input terminal (not depicted), and generates a vertical synchronization signal, a horizontal synchronization signal, etc., based on the video signal. The video signal, the vertical synchronization signal, and the horizontal synchronization signal are input from the display control portion 11 to the liquid crystal driving portion 22. The display control portion inputs the vertical synchronization signal and the horizontal synchronization signal to the backlight control portion 32.

The display control portion 11 generates a vertical synchronization signal having a drive frequency of 120 Hz acquired by doubling the speed of 60 Hz, i.e., the frequency of video signals of television broadcast. The display control portion 11 generates an interpolation image based on motion vectors detected from video signals of a plurality of frames and outputs a video signal with the interpolation image inserted between the two frames to the liquid crystal driving portion 22. An image of one frame may be output twice to the liquid crystal driving portion 22.

Therefore, the display control portion 11 has a conventionally well-known motion vector detecting function of detecting a motion vector used when generating the interpolation image, based on an input video signal. For example, the motion vector can be obtained by subdividing the video signals of two consecutive frames into a plurality of blocks and calculating magnitude and direction of movement between the two frames for each block. For example, well-known techniques such as an iterative gradient method and a block matching method are employed as a motion vector calculating method (see, e.g., Patent Document 2).

The display control portion 11 also has a conventionally well-known telop area detecting function of detecting, based on a motion vector detected by the motion vector detecting function, a telop area having the motion vector equal to or greater than predetermined magnitude set in advance and having a display position moving in a horizontal direction (an example of a predetermined direction) in the liquid crystal panel 21. In the telop area, characters representative of a news flash etc., are generally displayed in a scrolling manner.

It is conceivable that the telop area detecting function uses a simple technique of detecting, as a telop area, an area having a motion vector equal to or greater than predetermined magnitude set in advance for detecting a telop area. However, a normal image other than the telop area may have the same motion vector as the telop area. Therefore, it is desirable to accurately detect a telop area by using statistical information such as an amount of difference and a mean deviation between an average vector of an entire screen and a motion vector of each block (see, e.g., Patent Document 2).

The liquid crystal driving portion 22 drives the scanning electrodes (gate electrodes) and the data electrodes (source electrodes) making up the liquid crystal elements of the liquid crystal panel 21 based on a video signal, a vertical synchronization signal, and a horizontal synchronization signal input from the display control portion 11. Specifically, after the vertical synchronization signal is received, the liquid crystal driving portion 22 outputs a gate signal to the scanning electrodes in accordance with the horizontal synchronization signal corresponding to a first line and sequentially outputs the video signal corresponding to the first line to the data electrodes. As a result, the video signal is horizontally sequentially written to the liquid crystal elements of the first line. Subsequently, when the horizontal synchronization signal corresponding to a second line is input, the liquid crystal driving portion 22 outputs a gate signal to the scanning electrodes of the second line and sequentially outputs the video signal corresponding to the second line to the data electrodes. The same process is subsequently repeated to display video on the entire screen of the liquid crystal panel 21.

The liquid crystal driving portion 22 controls applied voltages to the respective liquid crystal elements corresponding to pixels of the liquid crystal panel 21 based on the video signal input from the display control portion 11 to change the transmission factors of the respective liquid crystal elements for illumination from the backlight device 31, thereby controlling the display gradations of pixels corresponding to the respective liquid crystal elements.

Figure 2:
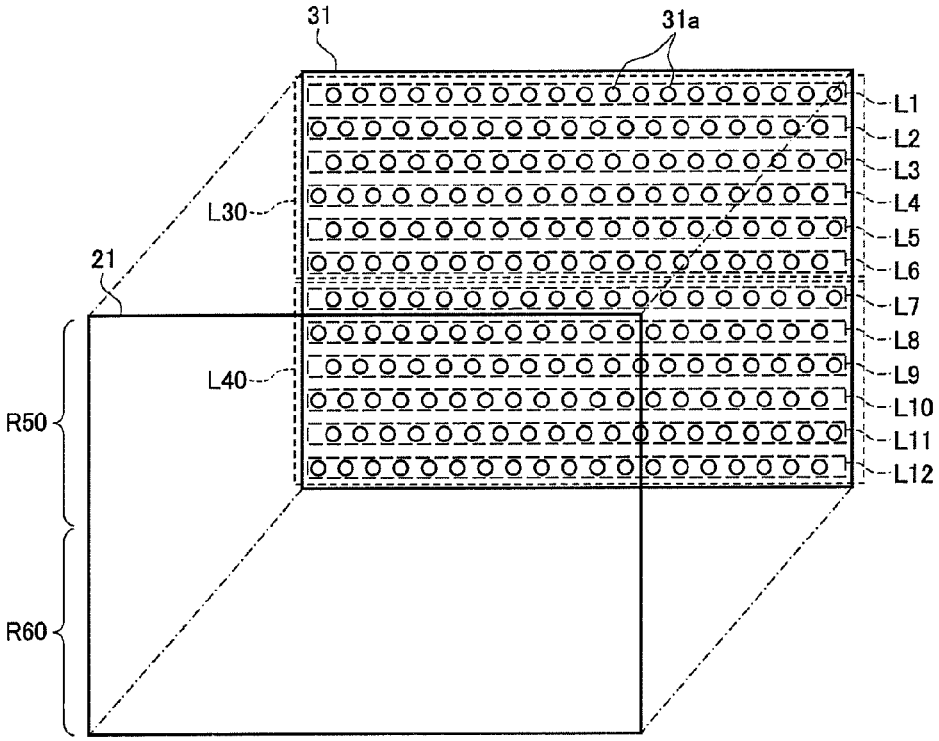
FIG. 2 is a schematic of an example of a backlight device disposed in the liquid crystal display device according to the embodiment of the present invention.

The backlight device 31 is disposed on the back surface of the liquid crystal panel 21 to illuminate the liquid crystal panel 21 from behind. FIG. 2 is a schematic of an example of a configuration of the backlight device 31.

As depicted in FIG. 2, the backlight device 31 has two LED light source groups L30 and L40 (examples of illuminating portion) corresponding to two partial areas R50 and R60 formed by vertically dividing the display area of the liquid crystal panel 21. The LED light source group L30 includes a plurality of LED light sources L1 to L6 consisting of a plurality of LEDs (light-emitting diodes) 31*a* arranged side-by-side in a horizontal direction of the liquid crystal panel 21. Similarly, the LED light source group L40 includes a plurality of LED light sources L7 to L12 consisting of a plurality of the LEDs 31*a* arranged side-by-side in a horizontal direction of the liquid crystal panel 21. The LED light sources L1 to L12 respectively correspond to a plurality of lines of display pixels of the liquid crystal panel 21.

The backlight device 31 individually blinks the LED light sources L1 to L12 on the basis of the LED light source groups L30 and L40 in accordance with control signals from the backlight control portion 32.

Although the display area of the liquid crystal panel 21 is divided into the two partial areas R50 and R60 and the backlight device 31 is divided into the two LED light source groups L30 and L40 in the example of this description, a configuration divided into three or more partial areas and LED light source groups may be considered as another embedment. The number of the LED light sources L1 to L12 is not limited to this example and the design may be changed as needed depending on a size of the liquid crystal panel 21. Although the backlight device 31 is a so-called direct-type LED backlight device having the LED light sources L1 to L12 disposed on the back side of the liquid crystal panel 21, the backlight device 31 may be any backlight device configured such that the liquid crystal panel 21 can be illuminated for each of a plurality of divided areas. For example, the backlight device 31 may be a so-called edge-type LED backlight device having a plurality of LEDs arranged side-by-side in a horizontal or vertical direction of the liquid crystal panel 21 correspondingly to the top and bottom or left and right edge portions of the liquid crystal panel 21 such that the light from each of the LEDs is guided by a light guide plate to illuminate the liquid crystal panel 21 from behind. Specifically, if a plurality of LEDs is arranged side-by-side in a vertical direction on the left and right edge portions of the liquid crystal panel 21, the backlight scan can be implemented by sequentially lighting the LEDs from top to bottom. If a plurality of LEDs is arranged side-by-side in a horizontal direction on the top and bottom edge portions of the liquid crystal panel 21, the backlight scan divided into two parts can be implemented by alternatively lighting the LEDs arranged side-by-side on the top portion and the LEDs arranged side-by-side on the bottom portion. The backlight scan can obviously be implemented if LEDs are disposed on each of the top, bottom, left, and right edge portions. The backlight device 31 may include a plurality of fluorescent tubes (cold-cathode tubes) arranged side-by-side in vertical direction of the liquid crystal panel 21 instead of the LED light sources L1 to L12.

The backlight control portion 32 executes a backlight scan process of sequentially intermittently lighting the LED light source groups L30 and L40 within a one-frame period in conjunction with writing of a video signal to the liquid crystal elements corresponding to each of the partial areas R50 and R60 in the liquid crystal panel 21. The backlight control portion 32 at the time of execution of this process corresponds to a backlight control portion. For example, the backlight control portion 32 switches between the turning on and off of the LED light source groups L30 and L40 each time a predetermined number of horizontal synchronization signals is input after the input of a vertical synchronization signal.

The one-frame period is a period for displaying an image of one frame on the liquid crystal panel 21, i.e., an interval between the vertical synchronization signals. Therefore, in the liquid crystal display device X with the liquid crystal panel 21 having an image write speed drive frequency) of 120 Hz, a one-frame period is 1/120 second (about 8.3 ms). The drive frequency of the liquid crystal panel 21 may obviously be 60 Hz or 240 Hz.

In the backlight scan process executed by the backlight control portion 32, if a constant relationship always exists between the write timing of the video signal to the liquid crystal elements in the partial areas R50 and R60 and the intermittent lighting timing of the LED light source groups L30 and L40, a position with the highest moving image performance is fixed in the partial areas R50 and R60. For example, if the intermittent lighting timing of the LED light source groups L30 and L40 is determined on the basis of the leading positions of the partial areas R50 and R60, the leading positions are always the areas having the highest moving image performance and, if an image with a larger motion vector such as a telop area is displayed in a place other than the leading positions, a pseudo contour of the image is easily noticeable.

Therefore, the liquid crystal display device X executes an intermittent lighting timing control process described later (see FIG. 3) by the display control portion 11 to adjust the relationship between the write timing of the video signal to the liquid crystal panel 21 and the intermittent lighting timing of the LED light source groups L30 and L40 in the backlight device 31 as needed, thereby intensively preventing the pseudo contour in a location where the pseudo contour is easily noticeable when a moving image is displayed. The display control portion 11 at the time of execution of this intermittent lighting timing control process corresponds to an intermittent lighting timing control portion.

Figure 3:
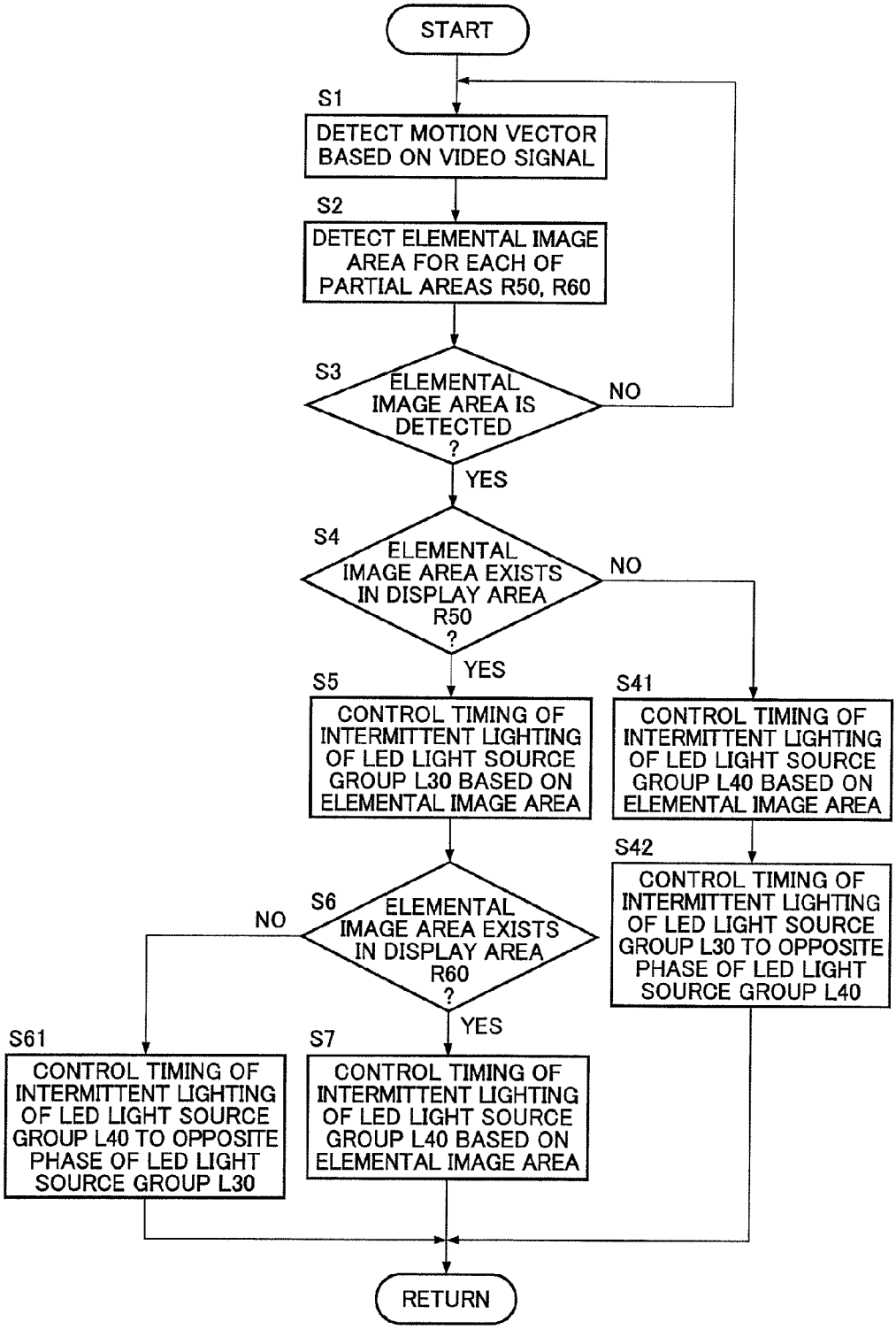
FIG. 3 is a flowchart for explaining an example of a procedure of an intermittent lighting timing control process in the liquid crystal display device according to the embodiment of the present invention.

An example of procedures of the intermittent lighting timing control process executed by the display control portion 11 will hereinafter be described with reference to a flowchart of FIG. 3. S1, S2, etc., depicted in FIG. 3 denote processing procedure (step) numbers.

(Steps S1 to S2)

At step S1, the display control portion 11 detects a motion vector based on video signals of two consecutive frames with the motion vector detecting function. The display control portion 11 at the time of execution of this process corresponds to a motion vector detecting portion.

At step S2, the display control portion 11 detects a telop area having a display position horizontally moving in the liquid crystal panel 21 based on the motion vector detected at step S1 for each of the partial areas R50 and R60 with the telop area detecting function. In this embodiment, the telop area is taken as an example of an elemental image area having a motion vector equal to or greater than predetermined magnitude set in advance causing an easily noticeable pseudo contour in this description. The display control portion 11 at the time of execution of this process corresponds to an elemental image area detecting portion.

As described above, a technique of calculating the motion vector and a technique of detecting the telop area may be implemented by using conventionally well-known various techniques (see, e.g., Patent Document 2) and will not be described in detail.

(Steps S3 to S4)

Figure 7:
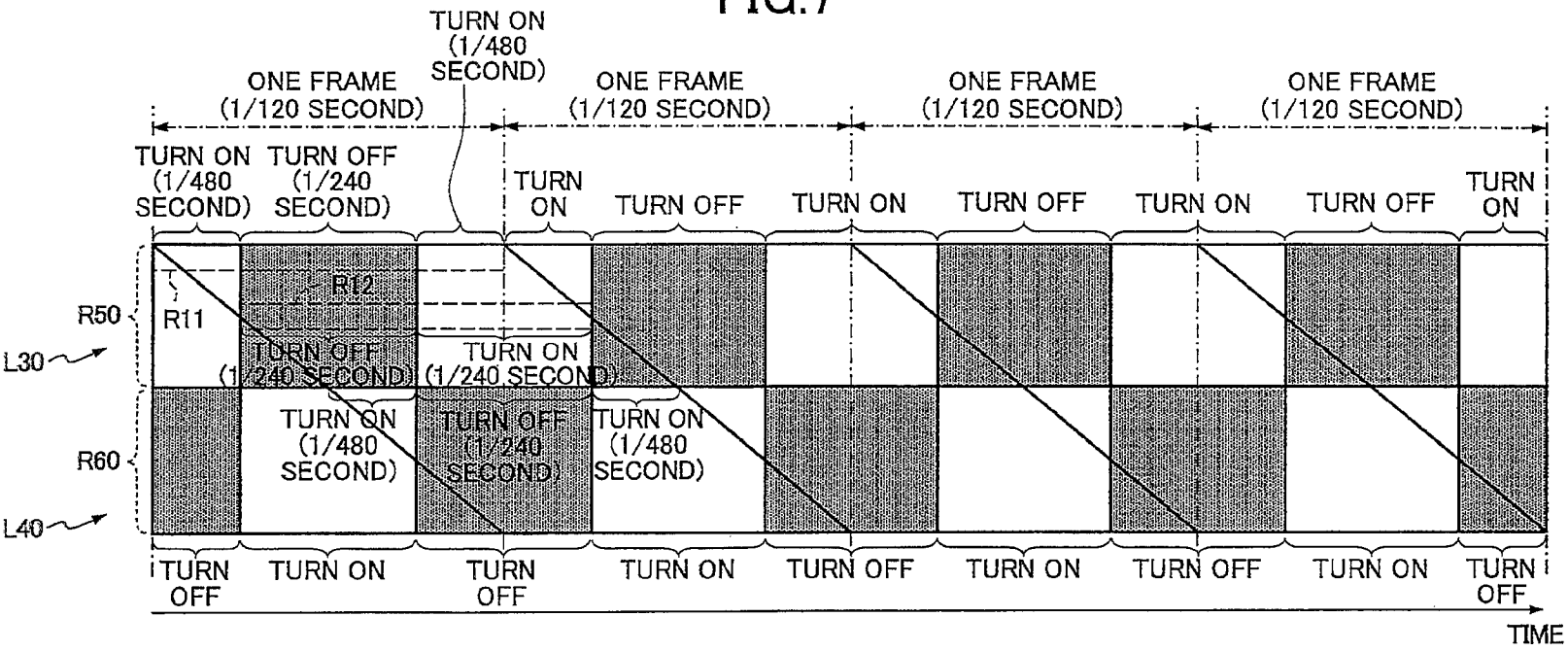
FIG. 7 is a diagram for explaining an example of a conventional backlight scan process.

At step S3, it is determined whether the display control portion 11 detects a telop area in at least one of the partial areas R50 and R60 at step S2. If it is determined that the telop area is detected (YES at S3), the process goes to step S4 and if the telop area is not detected (NO at S3), the process is returned to step S1. While the telop area is not detected at step S2 (NO at S3), the intermitted lighting timing of each of the LED light source groups L30 and L40 may be controlled on the basis of the leading portion of each of the partial areas R50 and R60 as depicted in FIG. 7, for example.

If the telop area is detected at step S3 (YES at S3), the display control portion 11 determines whether the telop area exists in the partial area R50 at subsequent step S4. If it is determined that the telop area exists in the partial area R50 (YES at S4), the process goes to step S5. If it is determined that the telop area does not exist in the partial area R50, i.e., if the telop area exists in the partial area R60 (NO at S4), the process goes to step S41.

(Step S5)

Figure 4:
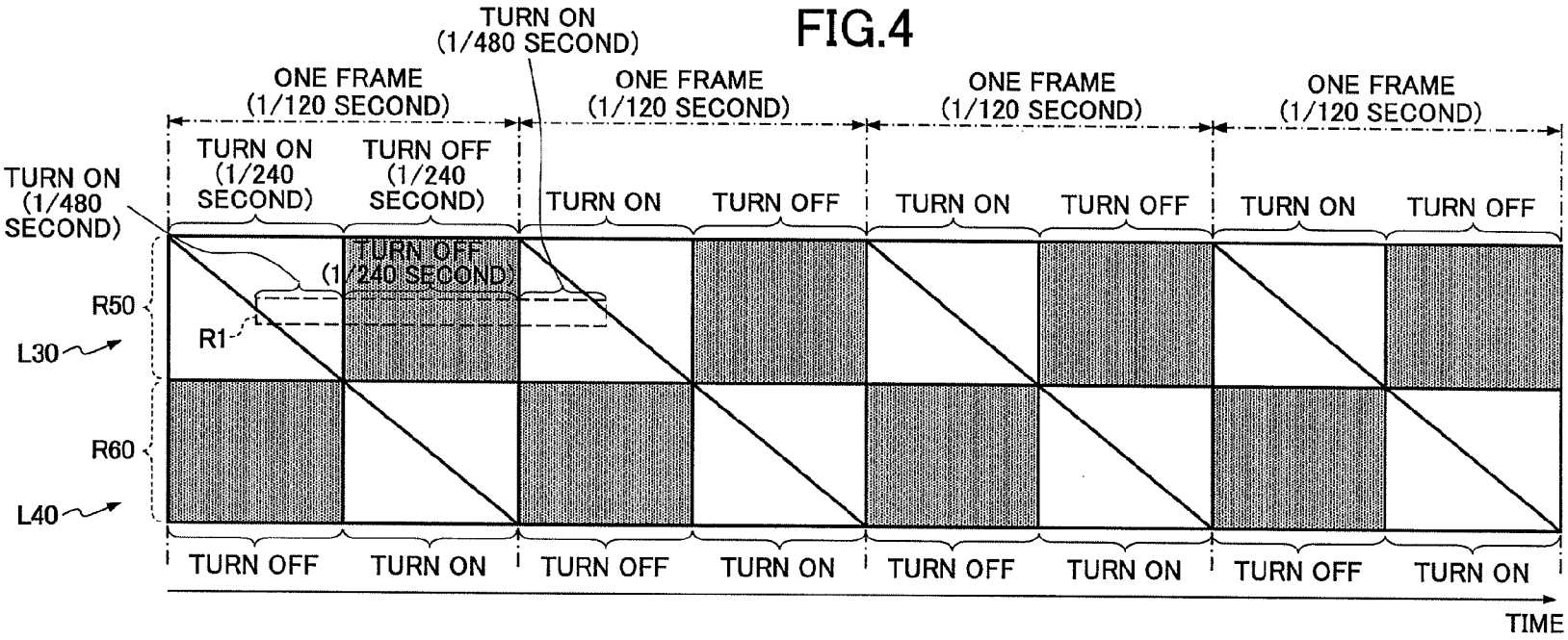
FIG. 4 is a diagram for explaining an example of an execution result of the intermittent lighting timing control process in the liquid crystal display device according to the embodiment of the present invention.

If it is determined that the telop area exists in the partial area R50 (YES at S4), the display control portion 11 controls the intermittent lighting timing of the LED light source group L30 on the basis of the telop area of the partial area R50 as depicted in FIG. 4 at subsequent step S5. In this example, it is assumed that a telop area R1 is detected in the vicinity of the center portion of the partial area R50.

Figure 8:
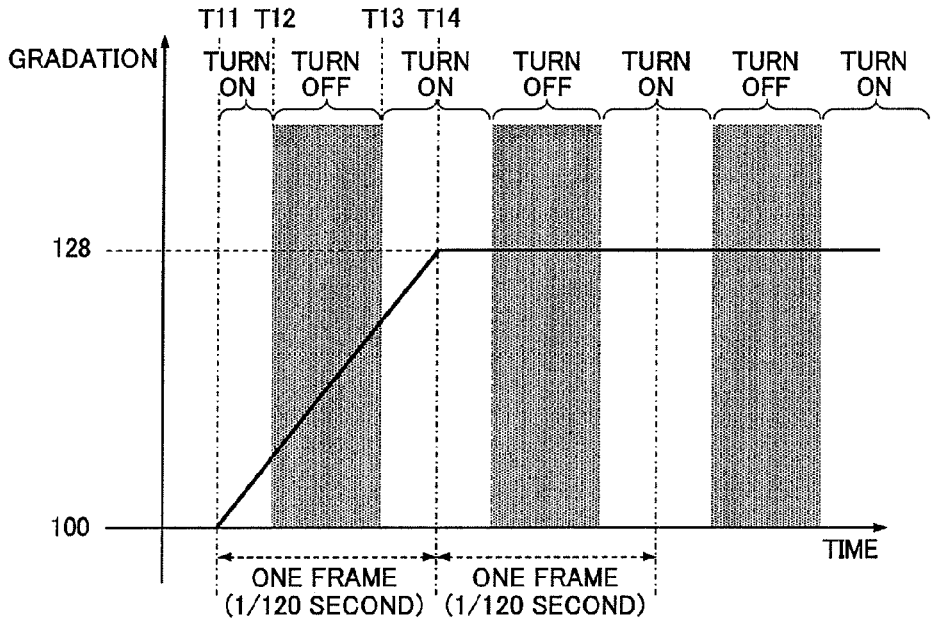
FIG. 8 is a schematic of an example of a relationship between write timing of a video signal and intermittent lighting timing.
Figure 9:
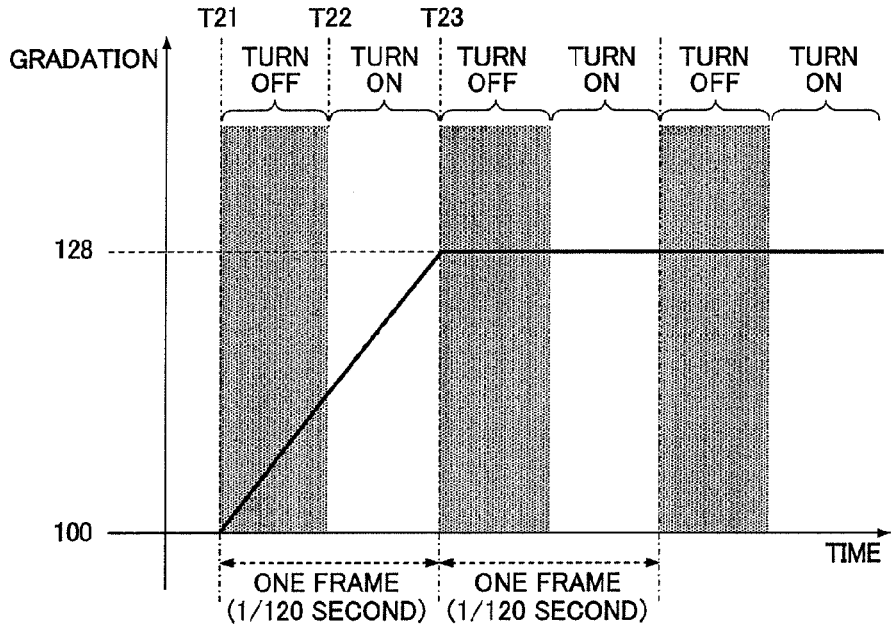
FIG. 9 is a schematic of an example of a relationship between write timing of a video signal and intermittent lighting timing.

In this case, the display control portion 11 controls the timing of intermittent lighting of the LED light source group L30 by the backlight control portion 32 such that the relationship between the write timing of the video signal to the telop area R1 of the partial area R50 and the intermittent lighting timing of the LED light source group L30 is achieved as a preset relationship in which the LED light source group L30 is intermittently lit in timing that causes the LED light source group L30 to be turned on for 1/480 second (time T11 to T12), turned off for 1/240 second (time T12 to T13), and turned on for 1/480 second (time T13 to T14) from the start of writing of the video signal to the liquid crystal elements corresponding to the center position of the telop area R1 as depicted in FIG. 8. As described above, this preset relationship is preliminarily set as a relationship producing the highest protection effect on the pseudo contour in the liquid crystal panel 21 (the same applies to the following description).

As a result, since the telop area R1 of the partial area R50 is provided with a turn-off period for a predetermined time (1/240 second) in the middle of a period from the start of writing of the video signal to the liquid crystal elements (start of response) until a response period has elapsed, and the LED light source group L30 is continuously turned on for a short time of 1/480 second during the response of the liquid crystal elements, the pseudo contour can intensively be prevented when a moving image is displayed and the moving image displaying performance can be improved. Since the time of the start of writing of the video signal at the center position of the telop area R1 is used as a reference, a difference of the pseudo contour between the start position and the end position of the telop area R1 is most suppressed.

At step S5 and steps S41, S42, S61, S7, etc., described later, a rapid change in the intermittent lighting timing of the LED light source group L30 or the LED light source group L40 may cause flickering of the displayed video on the liquid crystal panel 21 and, therefore, the intermittent lighting timing is desirably changed gradually during a plurality of frames, for example.

(Step S41 to S42)

Figure 5:
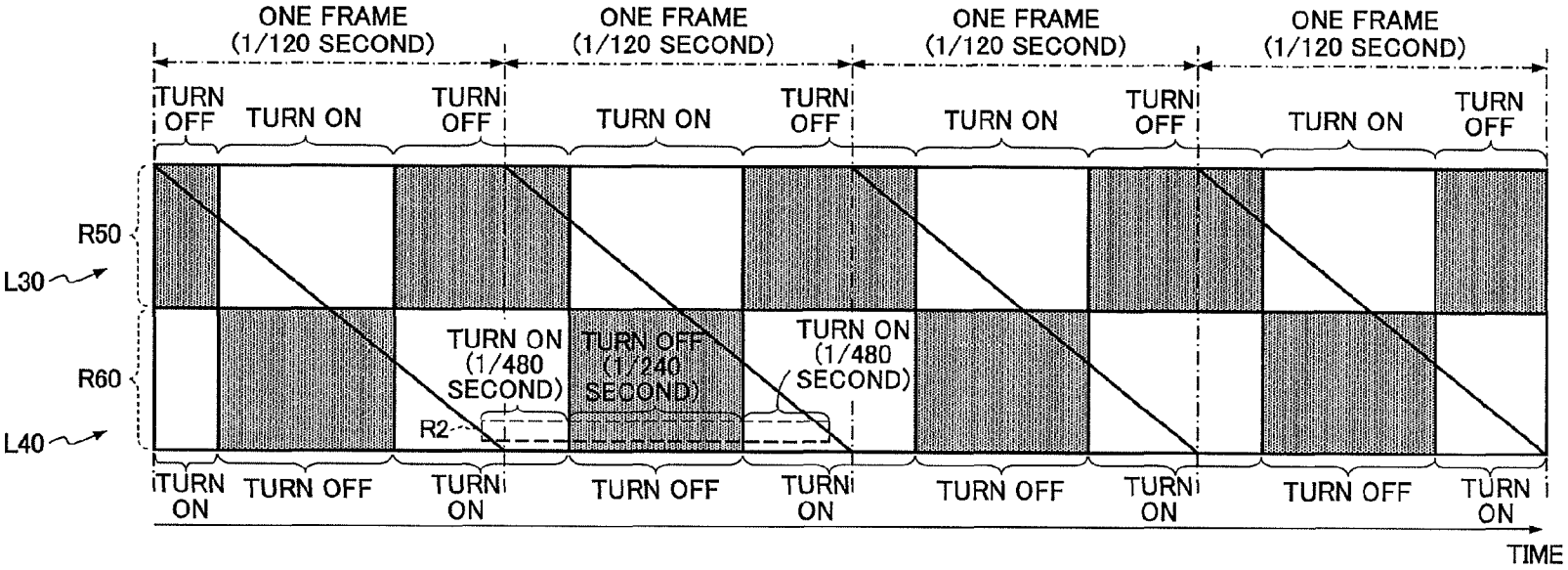
FIG. 5 is a diagram for explaining an example of an execution result of the intermittent lighting timing control process in the liquid crystal display device according to the embodiment of the present invention.

On the other hand, if it is determined that the telop area does not exist in the partial area R50 (NO at S4), the display control portion 11 controls the intermittent lighting timing of the LED light source group L40 on the basis of the telop area of the partial area R60 as depicted in FIG. 5 at subsequent step S41. In this example, it is assumed that a telop area R2 is detected in the vicinity of the lower end portion of the partial area R60.

In this case, the display control portion 11 controls the timing of intermittent lighting of the LED light source group L40 by the backlight control portion 32 such that the relationship between the write timing of the video signal to the telop area R2 of the partial area R60 and the intermittent lighting timing of the LED light source group L40 is achieved as a relationship in which the LED light source group L40 is intermittently lit in timing that causes the LED light source group L40 to be turned on for 1/480 second (time T11 to T12), turned off for 1/240 second (time T12 to T13), and turned on for 1/480 second (time T13 to T14) from the start of writing of the video signal to the liquid crystal elements corresponding to the center position of the telop area R2 as depicted in FIG. 8. As a result, since the telop area R2 of the partial area R60 is provided with a turn-off period for a predetermined time (1/240 second) in the middle of a period from the start of writing of the video signal to the liquid crystal elements (start of response) until a response period has elapsed, and the LED light source group L40 is continuously turned on for a short time of 1/480 second during the response of the liquid crystal elements, the pseudo contour can intensively be prevented when a moving image is displayed and the moving image displaying performance can be improved.

In this case, at step S42, the display control portion 11 gives a control command to the backlight control portion 32 such that the intermittent lighting timing (phase) of the LED light source group L30 is achieved as the opposite phase of the intermittent lighting timing of the LED light source group L40 as depicted in FIG. 5, and returns the process to step S1. As a result, since the LED light source groups L30 and L40 are alternatively turned on in the liquid crystal panel 21, the flickering of video is prevented.

(Step S6)

After step S5, the display control portion 11 determines whether the telop area exists in the partial area R60 at step S6. If it is determined that the telop area is detected in the partial area R60 at step S2 (YES at S6), the process goes to step S7 and if it is determined that the telop area is not detected in the partial area R60 (NO at S6), the process goes to step S61.

(Step S7)

Figure 6:
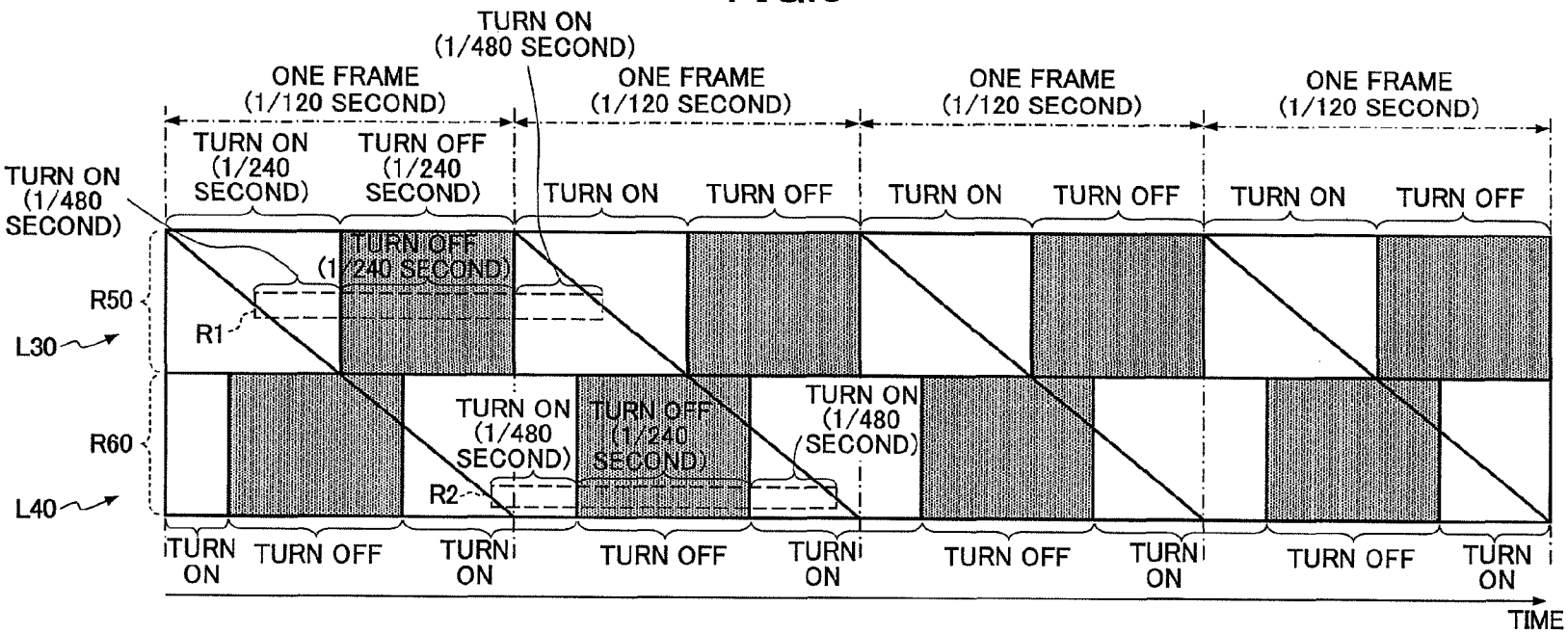
FIG. 6 is a diagram for explaining an example of an execution result of the intermittent lighting timing control process in the liquid crystal display device according to the embodiment of the present invention.

If the telop areas are detected in both the partial areas R50 and R60 (YES at S4 and S6), the display control portion 11 controls the intermittent lighting timing of the LED light source group L40 on the basis of the telop area of the partial area R60 as depicted in FIG. 6 at step S7. In this example, it is assumed that both the telop area R1 and the telop area R2 are detected in the vicinity of the center portion of the partial area R50 and in the vicinity of the lower end portion of the partial area R60, respectively.

In this case, as is the case with step S41, the display control portion 11 controls the timing of intermittent lighting of the LED light source group L40 by the backlight control portion 32 such that the relationship between the write timing of the video signal to the telop area R2 of the partial area R60 and the intermittent lighting timing of the LED light source group L40 is achieved as a relationship in which the LED light source group L40 is intermittently lit in timing that causes the LED light source group L40 to be turned on for 1/480 second (time T11 to T12), turned off for 1/240 second (time T12 to T13), and turned on for 1/480 second (time T13 to T14) from the start of writing of the video signal to the liquid crystal elements corresponding to the center position of the telop area R2 as depicted in FIG. 8.

As described above, if both the telop area R1 and the telop area R2 are detected in the vicinity of the center portion of the partial area R50 and in the vicinity of the lower end portion of the partial area R60, respectively, the display control portion 11 individually controls the timing of intermittent lighting of each of the LED light source group L30 and L40 by the backlight control portion 32 such that a preset relationship (see FIG. 8) is achieved between the write timing of the video signal in the telop areas R1 and R2 and the intermittent lighting timing of the LED light source groups L30 and L40 in the respective partial areas R50 and R60. Therefore, since the telop areas R1 and R2 of the respective partial areas R50 and R60 are provided with a turn-off period in the middle of a period from the start of response to the end of response of the liquid crystal elements, and the time of continuous lighting during the response is reduced to 1/480 second, the pseudo contour can intensively be prevented in each of the telop areas R1 and R2 and the moving image displaying performance can be improved.

(Step S61)

On the other hand, if the telop area is detected in the partial area R50 and the telop area is not detected in the partial area R60 (YES at S4 and NO at S6), the display control portion 11 gives a control command to the backlight control portion 32 at step S61 such that the intermittent lighting timing (phase) of the LED light source group L40 is achieved as the opposite phase of the intermittent lighting timing of the LED light source group L30 as depicted in FIG. 4, and returns the process to step S1. As a result, since the LED light source groups L30 and L40 are alternatively turned on in the liquid crystal panel 21, the flickering of video is prevented.

As described above, since the intermittent lighting timing control process is executed by the display control portion 11 in the liquid crystal display device X, the intermittent lighting timing of the LED light source groups L30 and L40 corresponding to the respective partial areas R50 and R60 of the liquid crystal panel 21 is changed as needed depending on a display position of a telop area (an example of the elemental image area) included in the partial areas R50 and R60, and the pseudo contour of the telop area can intensively be prevented.

Although this embodiment has been described by taking as an example the case of detecting a telop area for each of the partial areas R50 and R60 to intensively prevent the pseudo contours of the respective telop areas, it is conceivable that one telop area is detected from the whole of the liquid crystal panel 21 to intensively prevent the pseudo contour of the telop area in a partial area including the telop area and to set a phase of the intermittent lighting of the other partial area to the opposite phase.

Although this embodiment has been described by taking as an example the case of controlling the intermittent lighting timing of the LED light source groups L30 and L40 on the basis of the time of the start of writing of the video signal at the center positions of the telop areas R1 and R2, the intermittent lighting timing of the LED light source groups L30 and L40 may be controlled on the basis of the time of the start of writing of the video signal at the start or end of the telop areas R1 and R2.

This embodiment describes the case when the timing of intermittent lighting of the LED light source groups L30 and L40 by the backlight control portion 32 is controlled such that the relationship between the write timing of the video signal in the telop area and the intermittent lighting timing of the LED light source groups L30 and L40 is achieved as a preset relationship in which a turn-off period is provided for a predetermined time in the middle of a period from the start of writing of the video signal to the liquid crystal elements in the telop area until the response period of the liquid crystal elements has elapsed.

On the other hand, it is conceivable that the present relationship is varied depending on a degree of change in the gradation of the liquid crystal elements. For example, when a degree of change in the gradation of the liquid crystal elements is large, if the largest change in the gradation occurs immediately after the start of writing of the video signal to the liquid crystal elements, the state of the large change in gradation can be made less visible as far as possible by controlling the timing of intermittent lighting of the LED light source groups L30 and L40 by the backlight control portion 32 such that the turn-off period is provided immediately after the start of writing.

Example

Although the embodiment describes, as an example, the case of detecting the telop area at step S2 as an elemental image area having a motion vector equal to or greater than predetermined magnitude set in advance causing an easily noticeable pseudo contour, even when the telop area does not exist, if another elemental image area exists that has a motion vector equal to or greater than the predetermined magnitude set in advance, it is conceivable that the intermittent lighting timing of the LED light source groups L30 and L40 is controlled on the basis of the elemental image area.

For example, it is conceivable that an elemental image area having the largest motion vector is detected at step S2 from elemental image areas having motion vectors detected at step S1 equal to or greater than the predetermined magnitude set in advance. As a result, the pseudo contour can intensively be prevented in the elemental image area having the largest motion vector.

In another case, the pseudo contour is easily visible in an area having large contrast. Therefore, it is conceivable that an elemental image area having the largest contrast is detected at step S2 from elemental image areas having motion vectors detected at step S1 equal to or greater than the predetermined magnitude set in advance. As a result, the pseudo contour can intensively be prevented in the elemental image area having the largest contrast among the elemental image areas having reasonably large motion vectors.

An area may be identified as the elemental image area when the area is estimated to have the most noticeable pseudo contour as a result of evaluation using the predetermined weighting of magnitude of each of the motion vector and the contrast.

INDUSTRIAL AVAILABILITY

The present invention is available for liquid crystal display devices such as television receivers and displaying apparatuses.

EXPLANATIONS OF LETTERS OR NUMERALS

11 . . . display control portion; 21 . . . liquid crystal panel; 22 . . . liquid crystal driving portion; 31 . . . backlight device;

31*a* . . . LED; 32 . . . backlight control portion; L1 to L12 . . . LED light source; L30, L40 . . . LED light source group; R1, R2 . . . telop area; R50, R60 . . . partial area; and X . . . liquid crystal display device.

The invention claimed is:

1. A liquid crystal display device that has a backlight device including two illuminating portions for individually illuminating each of partial areas which is obtained by dividing a display area of a liquid crystal panel with a plurality of liquid crystal elements into two parts from behind, a backlight control portion sequentially intermittently lighting each of the illuminating portions in conjunction with writing of a video signal to the liquid crystal elements corresponding to the respective partial areas in the liquid crystal panel, and a motion vector detecting portion detecting a motion vector based on the video signal, comprising:

an elemental image area detecting portion for detecting an elemental image area where the motion vector detected by the motion vector detecting portion equals to or greater than predetermined magnitude set in advance from the partial areas for each of the partial areas; and an intermittent lighting timing control portion for controlling timing of intermittent lighting of the illuminating portion by the backlight control portion such that, if the elemental image area detecting portion detects the elemental image area only in one of the partial areas, a turn-off period is provided for a predetermined time in the middle of a period between the start of writing of a video signal to the liquid crystal elements corresponding to the elemental image area detected by the elemental image area detecting portion and the elapse of a response time of the liquid crystal elements based on timing of the start of writing of a video signal to the liquid crystal elements corresponding to the elemental image area and the two illuminating portions are alternatively turned on, and also if the elemental image area detecting portion detects the elemental image area in each of the partial areas, a turn-off period is provided for a predetermined time in the middle of a period between the start of writing of a video signal to the liquid crystal elements corresponding to the elemental image and the elapse of until a response time of the liquid crystal elements in each of the partial areas based on timing of the start of writing of a video signal to the liquid crystal elements corresponding to each of the elemental image areas.

2. The liquid crystal display device as defined in claim 1, wherein the elemental image area detecting portion detects an area where the motion vector equals to or greater than a predetermined magnitude set in advance and a display position moves in a predetermined direction of the liquid crystal panel as a telop area and handles the telop area as the elemental image area.

3. The liquid crystal display device as defined in claim 1, wherein the elemental image area detecting portion detects an elemental image area where the motion vector is the largest from elemental image areas where the motion vectors equal to or greater than a predetermined magnitude set in advance.

4. The liquid crystal display device as defined in claim 1, wherein the elemental image area detecting portion detects an elemental image area where contrast is the largest from elemental image areas where the motion vectors equal to or greater than a predetermined magnitude set in advance.

* * * * *